US006265856B1

(12) United States Patent
Cali' et al.

(10) Patent No.: US 6,265,856 B1
(45) Date of Patent: Jul. 24, 2001

(54) LOW DROP BICMOS/CMOS VOLTAGE REGULATOR

(75) Inventors: Giovanni Cali' , Catania; Mario Paparo, S. Giovanni la Punta; Roberto Pelleriti, Catania, all of (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/595,762

(22) Filed: Jun. 16, 2000

(30) Foreign Application Priority Data

Jun. 16, 1999 (EP) ..... 99830374

(51) Int. Cl.[7] ..... G05F 1/40; G05F 1/569; G05F 5/00

(52) U.S. Cl. ..... 323/273; 323/276; 323/303; 323/280

(58) Field of Search ..... 323/273, 274, 323/276, 270, 280, 281, 303

(56) References Cited

U.S. PATENT DOCUMENTS

| | | | | |
|---|---|---|---|---|
| 4,928,056 | * | 5/1990 | Pease | 323/314 |
| 5,280,233 | * | 1/1994 | Poletto et al. | 323/269 |
| 5,373,225 | * | 12/1994 | Poletto et al. | 323/282 |
| 5,625,278 | | 4/1997 | Thiel et al. | 323/280 |
| 5,631,598 | * | 5/1997 | Miranda et al. | 327/540 |
| 5,686,821 | * | 11/1997 | Brokaw | 323/273 |
| 5,861,736 | * | 1/1999 | Corsi et al. | 323/273 |
| 5,939,867 | * | 8/1999 | Capici et al. | 323/277 |
| 5,945,819 | * | 8/1999 | Ursino et al. | 323/282 |
| 6,037,826 | * | 3/2000 | Poletto et al. | 327/375 |
| 6,040,736 | * | 3/2000 | Milanesi et al. | 327/541 |
| 6,157,176 | * | 12/2000 | Pulvirenti et al. | 323/266 |

FOREIGN PATENT DOCUMENTS

| | | | |
|---|---|---|---|
| 0810504A | 12/1997 | (EP) | G05F/1/00 |
| 0864956A | 9/1998 | (EP) | G05F/3/24 |

* cited by examiner

*Primary Examiner*—Peter S. Wong
*Assistant Examiner*—Bao Q. Vu
(74) *Attorney, Agent, or Firm*—Theodore E. Galanthay; Robert Iannucci; Seed IP Law Group PLLC

(57) ABSTRACT

Presented is a low-drop type of voltage regulator formed with BiCMOS/CMOS technology. The regulator includes an input terminal that receives a stable voltage reference connected to one input of an operational amplifier through a switch controlled by a power-on enable signal. A supply voltage reference powers the operational amplifier. The regulator includes an output transistor connected to an output of the amplifier to generate a regulated voltage value to be fed back to the amplifier input. A second transistor is connected in series between the output transistor and the supply voltage reference. The regulator uses a control circuit portion connected between the control terminal of the second transistor and the supply voltage reference to prevent the breakdown of the output transistor from occurring.

17 Claims, 4 Drawing Sheets

LOW DROP BICMOS/CMOS VOLTAGE REGULATOR

TECHNICAL FIELD

This invention relates to a low-drop type of voltage regulator formed with BiCMOS/CMOS technology.

BACKGROUND OF THE INVENTION

The technical field of radiofrequency signal transmission and reception requires that GSM or DCS devices be provided which can even operate on varying supply voltages, generally between 3V and 5V.

This demand is made today more pressing by the availability of portable telephone sets of the dual band type, which can be operated at both the GSM and DCS frequency standards.

To that aim, it becomes necessary to provide such devices with voltage regulators effective to produce a stable working voltage and capable of accommodating variations in the supply voltage or disturbance of any kind.

Further, to provide electronic devices, integrated monolithically in a single chip, which can operate on signals at frequencies in the GHz range, a technology is required which allows of the integration of components active at very high cut-off frequencies on the order of a few tens of GHz. This involves of necessity the minimization of any parasitic capacitances which, if allowed to appear in the device, could limit the working frequency substantially.

In the instance of circuits integrated with CMOS technology, minimizing the parasitic capacitances is obtained by reducing the thickness of the gate oxide layer of MOS transistors to a minimum. While this can make the transistors extremely fast, it has the disadvantage of lowering their maximum sustainable working voltage; MOS transistors so constructed would exhibit low gate-source or gate-drain breakdown voltages.

In the instance of circuits integrated with bipolar technology, reducing the parasitic capacitances is obtained by reducing the width of the base region as well as the time allowance for the carriers passage through the base region. Here again, the transistor capacity to sustain high working voltages is concurrently reduced; bipolar transistors with this construction would have a low collector-emitter breakdown voltage.

The problem of how to provide GSM-DCS dual band devices operating on varying supply voltages has been addressed by using a combined BiCMOS technology which allows of breakdown voltages up to 3.5V for both bipolar and MOS transistors.

A prior art voltage regulator constructed with BiCMOS/CMOS technology is shown by way of example in FIG. 1 herewith.

This regulator comprises an operational amplifier OPAMP having an output connected to the control terminal of a PMOS transistor M1 to produce a regulated voltage value Vreg.

An input terminal In of the regulator receives a voltage reference Vrif which is applied to the inverting input of the amplifier through a switch controlled by a signal CE (Chip Enable); this signal being a CMOS digital signal arranged to control the turning on/off of the whole device.

The regulated output terminal is fed back to the amplifier inputs through a resistor divider formed of a resistor pair R1, R2. This divider is connected in parallel with an output capacitor C. In essence, upon the occurrence of a variation in the supply, the output voltage value Vreg is fed back to the input of an error amplifier OPAMP at a ratio of R1/(R1+R2) for comparison with a reference voltage Vrif.

The regulated voltage Vreg is given by the following relation:

$$Vreg=Vrif(1+R1/R2)$$

The output PMOS transistor should be of such dimensions as to ensure operation in the saturation range at the largest delivered current.

In addition, the output capacitor C allows a dominant pole compensation to be carried out and affords good rejection of supply disturbance at all the frequencies.

While being advantageous in many ways, this prior solution has a drawback in that, with the regulator in the "off" state, the voltage Vgd across the gate and drain terminals of the transistor M1 and the voltage Vsd across the source and drain terminals of the transistor M1 are equal to the supply voltage Vpos of the device. Where this voltage Vpos is higher than the gate-drain and source-drain breakdown voltages, the condition becomes unacceptable for the device operation because it would cause the output PMOS transistor M1 to fail.

A viable prior solution to this problem is illustrated schematically by FIG. 2.

Unlike the example of FIG. 1, a cascode structure is shown in FIG. 2, wherein a series of PMOS transistors M1, M2 are employed, with the gate terminal of the transistor M2 being held at a voltage reference Vg2.

This solution has a drawback in that it cannot be applied to low drop regulators, since large-size transistors would be needed which occupy a large circuit area and make compensation difficult from the presence of high parasitic capacitances.

Therefore, until now, no viable solution exits to that can provide a voltage regulator of the low drop type, for construction with BiCMOS/CMOS technology, which has such structural and functional features as to be usable with higher supply voltages than the breakdown voltage of active components, thereby overcoming the limitations of prior art circuits.

SUMMARY OF THE INVENTION

Embodiments of this invention have a circuit portion connected between the output of the operational amplifier in the regulator and the supply thereto, which is effective to prevent breakdown of the output PMOS transistor when the regulator is in the "off" state.

Presented is a regulator as above which includes an input terminal, that receives a stable voltage reference and being connected to one input of an operational amplifier through a switch controlled by a power-on enable signal. A supply voltage reference powers the regulator. An output transistor is connected to an output of the amplifier to generate a regulated voltage value to be fed back to the amplifier input. Finally, the regulator includes a second transistor connected in series between the output transistor and the supply voltage reference.

The features and advantages of a regulator according to the invention will become apparent from the following description of an embodiment thereof, given here by way of example and not of limitation with reference to the accompanying drawings.

DETAILED DESCRIPTION OF THE INVENTION

Figure 3:
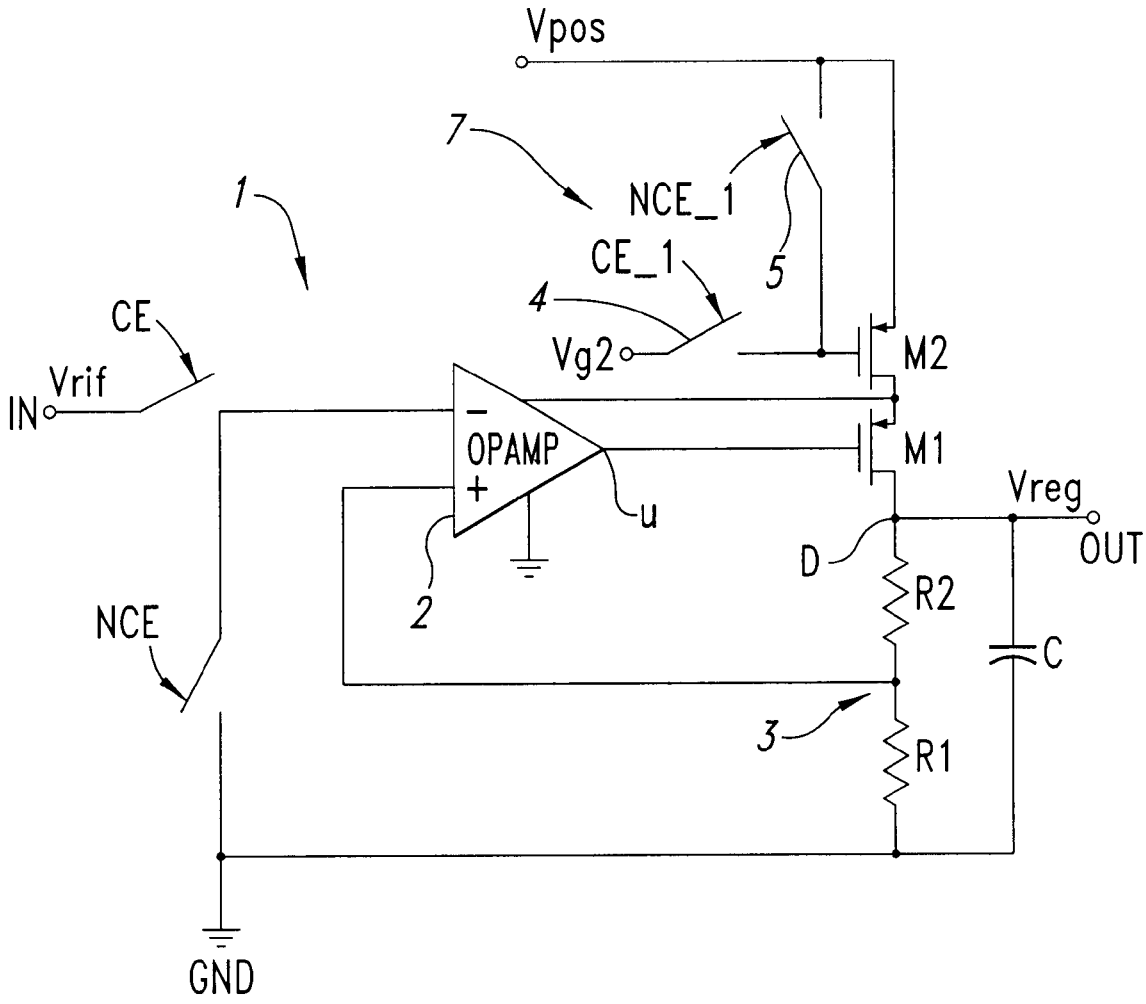
FIG. 3 is a schematic drawing of a low drop voltage regulator according to an embodiment of the invention.

Referring to the drawing views, specifically to the example of FIG. 3, a voltage regulator formed with BiCMOS/CMOS technology according to an embodiment of the invention is generally shown schematically at 1. The regulator is particularly useful in integrated electronic devices which are operated at higher supply voltages than the device breakdown voltages.

The regulator 1 is intended, particularly but not exclusively, for incorporation to an integrated telephone circuit for dual band applications in conformity with the GSM and/or DCS standards for radiofrequency transmission.

The regulator 1 includes an operational amplifier 2 having an output U, and having an inverting (−) first input and a non-inverting (+) second input.

The regulator 1 has an input terminal IN connected to the inverting (−) input of the amplifier 2 through a switch which is controlled by an enable signal CE. The signal CE (Chip Enable) represents the activating signal for the whole integrated circuit in which the regulator 1 is incorporated. The input terminal IN accepts a reference potential Vrif.

The inverting (−) input of the amplifier 2 is also connected to a supply reference, such as a ground GND, through a second switch which is controlled by a signal NCE. This signal NCE represents the logic negation of the signal CE. Thus, the inverting (−) input of the amplifier 2 is always connected to either Vrif or to GND, but never to both.

The output U of the amplifier 2 is connected to the control terminal of an output PMOS transistor M1 having its drain terminal D linked to the ground reference GND by a resistive divider 3 which comprises first R1 and second R2 resistors. The interconnecting node between the resistors R1 and R2 is feedback connected to the non-inverting (+) input of the amplifier 2.

An output capacitor C is in parallel with the resistive divider 3. The drain terminal of the transistor M1 also represents an output terminal OUT for the regulator 1 where a regulated voltage value Vreg will be output.

Advantageously, the regulator 1 further comprises a second MOS transistor M2 connected in series with the MOS transistor M1. Although this transistor is again of the PMOS type, both transistors M1, M2 could well be of the NMOS type, for a negative regulator.

The drain terminal of the second transistor M2 is connected to the source terminal of the transistor M1 and also represents the virtual supply to the amplifier 2 of the regulator 1. Further, the source terminal of the second transistor M2 is connected to a supply voltage reference Vpos.

Advantageously, a control circuit portion 7 is connected between the output U of the operational amplifier 2 and the supply voltage reference Vpos of the regulator 1, and is operative to turn on/off the transistor M2.

More particularly, the circuit portion 7 includes a switch 4 connected between the gate terminal of the second transistor M2 and a voltage reference Vg2. The switch 4 is controlled by a signal CE_1.

The signal CE_1 is suitably timed relative to the signal CE such that the transistor M2 is never turned on ahead of the transistor M1 and overvoltages at the source terminal of the output transistor M1 are prevented from occurring.

Provided downstream of the switch 4 is a second switch 5 which is connected between the gate terminal of the second transistor M2 and the supply voltage reference Vpos. This second switch 5 of the circuit portion 7 is controlled by a signal NCE_1 being the logic negation of the signal CE_1. Thus, the gate terminal of the second MOS transistor 2 is either connected to the supply voltage reference Vpos, or the voltage reference Vg2, but not to both.

The operation of the voltage regulator 1 will now be described.

The transistor M2 functions as a switch, and in normal operating conditions, with the signal CE having a high logic value, the transistor M2 will be in the ON state.

Figure 1:
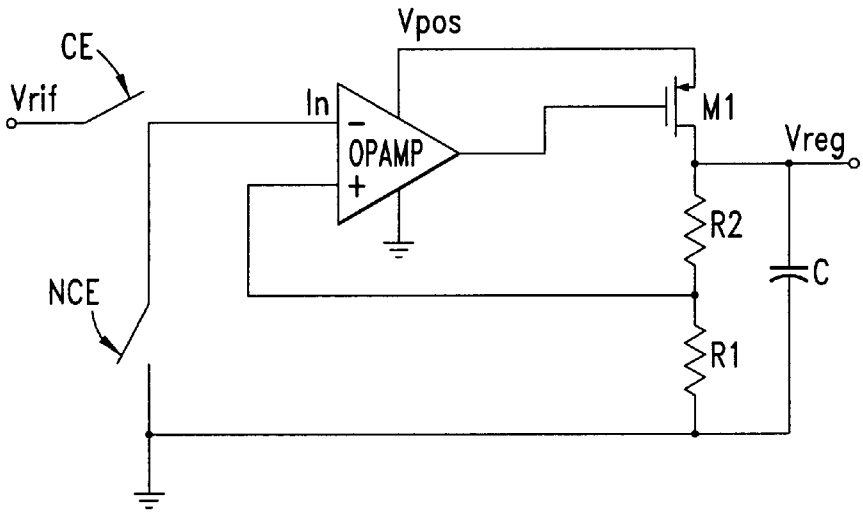
Fig. 1 (Prior Art)
FIG. 1 is a schematic drawing of a prior art voltage regulator.
Figure 2:
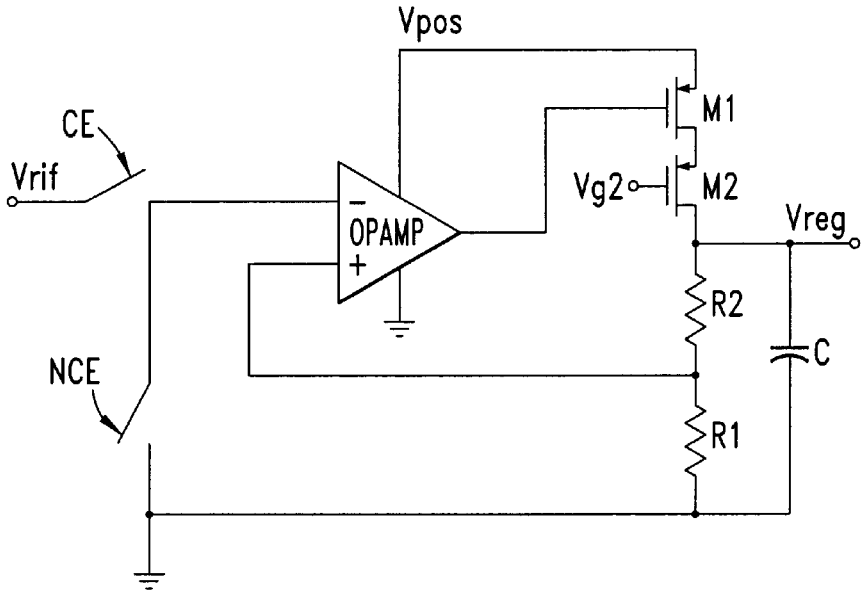
Fig. 2 (Prior Art)
FIG. 2 is a schematic drawing of another prior art voltage regulator.

As the regulator 1 is turned off by the signal CE going to a low logic value, the whole circuit is in the OFF state and the regulator structure is equivalent to the cascode structure shown in FIG. 2.

This removes the risk of breakdown of the transistor M1 in the OFF condition, since the structure comprising M1 and M2 is the equivalent of a cascode, but without the need for increased area availability since it is no longer necessary to ensure operation of the transistor M2 in the saturation range at the largest delivered current.

The circuit portion 7 will be cut off upon the enable signal CE being restored to a high logic value.

Figure 4:
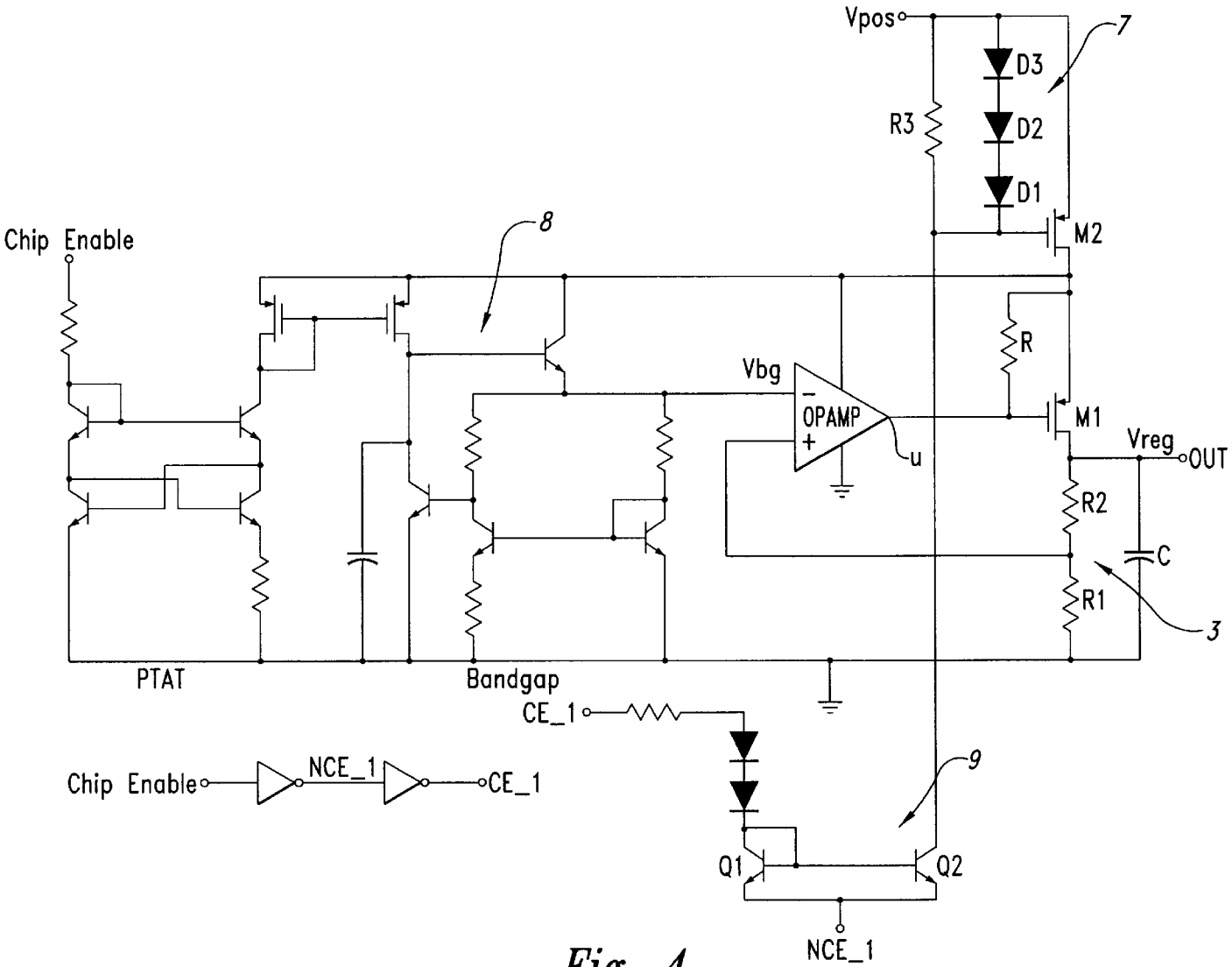
FIG. 4 is a schematic drawing showing the voltage regulator of FIG. 3 in greater detail.

Shown in FIG. 4 by way of non-limitative example is a possible circuit embodiment of the schematic diagram of FIG. 3 using a BiCMOS technology.

The example of FIG. 4 includes a bandgap cell 8 for producing the reference potential Vrif to be applied to the regulator 1 input. The regulator includes an amplifier 2 in a feedback loop which is effective to return the bandgap voltage to the resistive divider 3, where this reference will be amplified and brought back to a regulated voltage value Vreg.

The regulated voltage obeys the following relation:

$$Vreg=Vbg*(1+R1/R2)$$

This embodiment has been tested by the Applicant using a supply voltage of 5V and a breakdown voltage of 3.5V. The switches 4 and 5 were, by way of example, formed of a series of diodes D1, D2, D3 connected in parallel to a resistor R3 and driven from a control circuitry 9. The diodes were connected in series with one another between the gate terminal of transistor M2 and the supply voltage reference Vpos.

This control circuitry 9 uses a pair of bipolar NPN transistors Q1, Q2 having their respective base and emitter terminals connected together, the collector terminal of the transistor Q2 being connected to drive the gate terminal of the transistor M2.

In normal operating conditions, with the signal CE high, the diodes D1, D2, D3 are "on" and function to supply a high voltage Vsg to the transistor M2, with an attendant voltage Vsd low. In this way, the regulator 1 of this invention operates properly in normal operating conditions.

Conversely, in the "off" state, with the signal CE low, the circuit ensures that the source or the gate terminal of the output transistor M1 never attains a voltage level which can bring it to breakdown, since an equivalent structure of the cascade structure is created.

The regulator can operate on higher supply voltages then the breakdown voltage of the active components incorporated to the regulator. In essence, the structure is the equivalent of a cascode structure in the "off" condition, but in normal conditions of operation it is as if it did not interfere at all with the activity of the regulator, even at a low supply voltage (low drop), since the transistor M2 is the equivalent of a short circuit.

Figure 5:
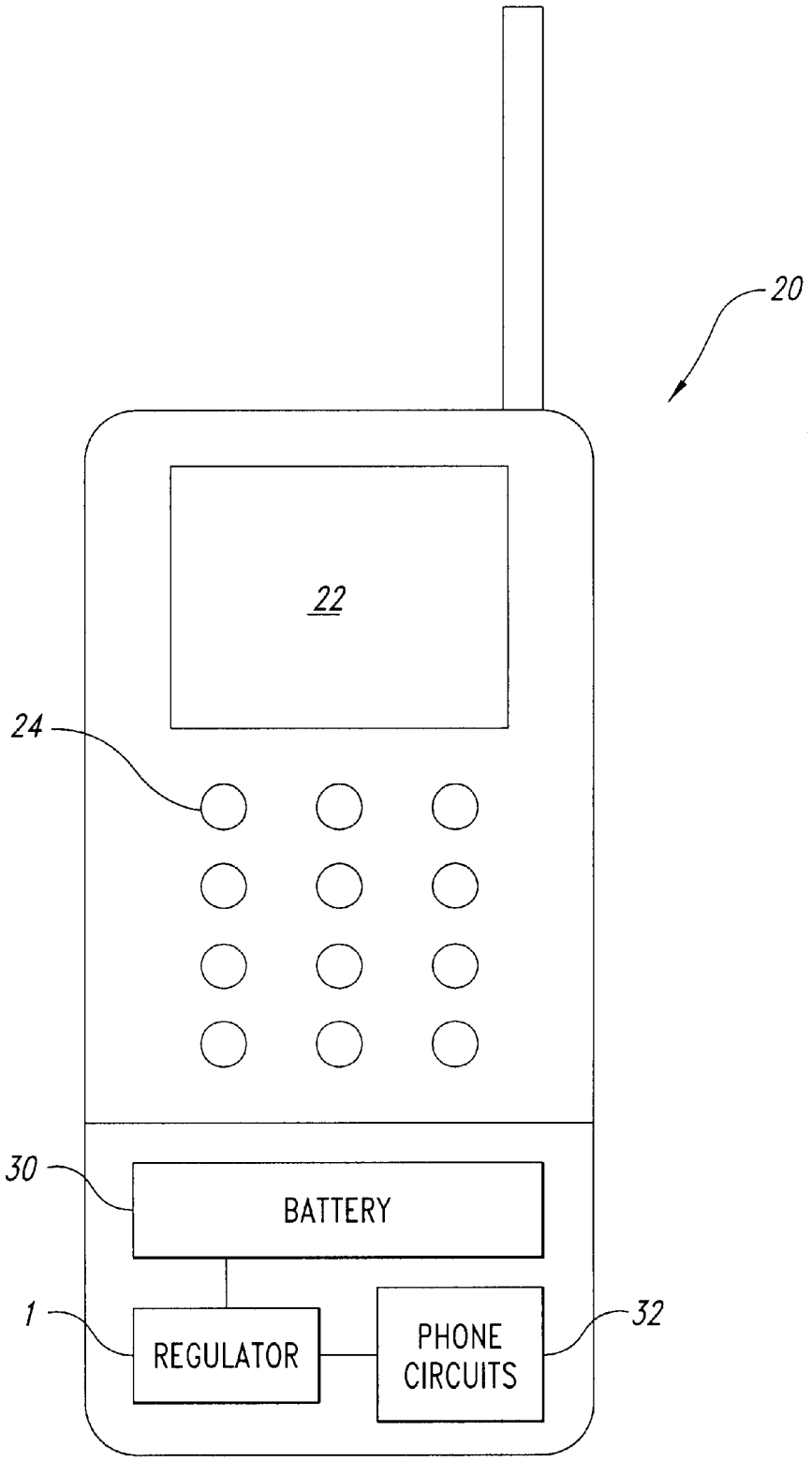
FIG. 5 is a cellular phone incorporating a voltage regulator such as that of FIG. 3.

FIG. 5 shows a cellular phone 20 that uses a voltage regulator 1 such as the one shown in FIG. 3 or 4. Part of the phone 20 includes a screen 22 for displaying information to a user of the phone, and a set of buttons 24 that allow the user to input data to the phone. A voltage source, such as a battery 30 is incorporated into the phone 20. It should be noted that drawing in FIG. 5 is meant to show functional structures of the phone 20, and not necessarily the physical structures themselves. For instance, many batteries for cellular phones are roughly the same size as the phones themselves and mounted on the back of the phones, while in FIG. 5 the battery 30 is shown as a small box. In this functional diagram, they are equivalent. Coupled to the battery 30 is a voltage regulator, such as the regulator 1, from FIG. 3 or 4. The voltage regulator 1 is coupled to phone circuits 32, or any other circuit used by the phone 20 that requires or uses a voltage that is regulated by the voltage regulator 1.

Changes can be made to the invention in light of the above detailed description. In general, in the following claims, the terms used should not be construed to limit the invention to the specific embodiments disclosed in the specification and the claims, but should be construed to include all methods and devices that are in accordance with the claims. Accordingly, the invention is not limited by the disclosure, but instead its scope is to be determined by the following claims.

What is claimed is:

1. A low-drop voltage regulator formed with BiCMOS/CMOS technology and comprising:

an input terminal structured to receive a stable voltage reference and being connected to a first input of an operational amplifier through a switch controlled by a power-on enable signal;

a supply voltage reference powering the regulator;

an output transistor connected to an output of the operational amplifier to generate a regulated voltage value fed back to a second input of the operational amplifier;

a second transistor connected in series between the output transistor and said supply voltage reference; and a control circuit portion coupled between a control terminal of the second transistor and said supply voltage reference and structured to prevent the breakdown of the output transistor from occurring.

2. The regulator according to claim 1 wherein said control circuit portion comprises:

a first controlled switch, connected between a second voltage reference and said control terminal of the second transistor; and a second controlled switch, connected between said control terminal of the second transistor and said supply voltage reference.

3. The regulator according to claim 2 wherein said first structured switch is structured to be controlled by an enable signal which is offset in time from said regulator power-on enable signal.

4. The regulator according to claim 1 wherein the control circuit portion comprises:

a series of diodes connected between the control terminal of the second transistor and said supply voltage reference.

5. The regulator according to claim 4, further comprising a resistor coupled in parallel with said series of diodes.

6. The regulator according to claim 1 wherein said control circuit portion is structured to create an equivalent structure of a cascode structure when the regulator is in an OFF state.

7. The regulator according to claim 3 wherein the control circuit portion is structured to be cut off upon the enable signal being restored to a high logic value.

8. An integrated telephone circuit of the dual band type, incorporating at least one voltage regulator as claimed in claim 1.

9. A method of operating a low drop voltage regulator powered by a supply voltage reference and having an operational amplifier, an output transistor coupled to an output of the operational amplifier, and a protection transistor coupled in series with the output transistor that is driven by a control circuit, the method comprising:

coupling a stable reference voltage to a first input of the operational amplifier when a first enable signal is present;

driving the output transistor with a signal generated at the output of the operational amplifier to produce a regulated voltage;

feeding back the regulated voltage to a second input of the operational amplifier; and controlling the operation of the protection transistor in order to prevent overvoltages from the supply reference voltage from being transmitted to the output transistor.

10. The method of claim 9 wherein controlling the operation of the protection transistor comprises creating an equivalent cascode structure between the supply voltage reference and the output transistor.

11. The method of claim 9 wherein the protection transistor is coupled between the supply voltage reference and the output transistor, and wherein controlling the operation of the protection transistor comprises:

turning on the protection transistor a controlled time after the presence of the first enable signal; and turning off the protection transistor to disconnect the output transistor from the supply voltage reference when the first enable signal is not present.

12. The method of claim 11 wherein turning on the protection transistor comprises:

deriving a second signal from the first enable signal; and driving a current mirror circuit with the second signal.

13. The method of claim 12 wherein driving a current mirror circuit comprises:

providing the second signal to a collector and a base of a first bipolar transistor, and to a base terminal of a second bipolar transistor; and transmitting a signal from a collector of the second bipolar transmitter to a control gate of the protection transistor.

14. The method of claim 13 wherein the control gate of the protection transistor is coupled to the supply voltage reference by at least one diode.

15. The method of claim 14 wherein the control gate of the protection transistor is also coupled to the supply voltage reference by a resistance coupled in parallel with the at least one diode.

16. The method of claim 15 wherein a conduction terminal of the protection transistor is directly coupled to the supply voltage reference.

17. The method of claim 9 further comprising coupling the first input of the operational amplifier to a ground voltage when the first enable signal is not present.

* * * * *